US010055957B2

(12) United States Patent
Barbosa

(10) Patent No.: US 10,055,957 B2
(45) Date of Patent: Aug. 21, 2018

(54) APPARATUS, SYSTEM, AND METHOD FOR A HYBRID ARTICLE SURVEILLANCE TAG

(71) Applicant: STATOS DO BRASIL SOLUTIONS LTDA., Belo Horizonte (BR)

(72) Inventor: Guilherme Souza Barbosa, Belo Horizonte (BR)

( * ) Notice: Subject to any disclaimer, the term of this patent is extended or adjusted under 35 U.S.C. 154(b) by 0 days.

(21) Appl. No.: 15/295,735

(22) Filed: Oct. 17, 2016

(65) Prior Publication Data

US 2018/0108232 A1 Apr. 19, 2018

(51) Int. Cl.
*G08B 13/14* (2006.01)
*G08B 13/24* (2006.01)

(52) U.S. Cl.
CPC ..... *G08B 13/2448* (2013.01); *G08B 13/2414* (2013.01); *G08B 13/2422* (2013.01)

(58) Field of Classification Search
CPC ..... G08B 13/2434; G08B 13/2414; G08B 13/2422
See application file for complete search history.

(56) References Cited

U.S. PATENT DOCUMENTS

2006/0250250 A1* 11/2006 Youn ..... G06K 19/07749 340/572.7
2009/0189768 A1* 7/2009 Copeland ..... G08B 13/2408 340/572.7
2016/0351035 A1* 12/2016 Wong ..... G08B 13/2434
2017/0178479 A1* 6/2017 Ellers ..... G08B 13/2434

* cited by examiner

*Primary Examiner* — Tai T Nguyen
(74) *Attorney, Agent, or Firm* — Brown IP Law LC; Kerry W. Brown

(57) ABSTRACT

A hybrid tag. The hybrid tag includes an RFID component, an acousto-magnetic component, and a flexible container. The RFID component includes an RFID antenna and an integrated circuit connected to the RFID antenna. The acousto-magnetic component includes an amorphous metal and a magnetic metal disposed on the amorphous metal. The flexible container covers the RFID component and the acousto-magnetic component.

15 Claims, 7 Drawing Sheets

APPARATUS, SYSTEM, AND METHOD FOR A HYBRID ARTICLE SURVEILLANCE TAG

CROSS-REFERENCE TO RELATED APPLICATIONS

N/A

SUMMARY

An embodiment of the invention provides a hybrid tag. The hybrid tag includes an RFID component, an acousto-magnetic component, and a flexible container. The RFID component includes an RFID antenna and an integrated circuit connected to the RFID antenna. The acousto-magnetic component includes an amorphous metal and a magnetic metal disposed on the amorphous metal. The flexible container covers the RFID component and the acousto-magnetic component. Other embodiments are also described.

BRIEF DESCRIPTION OF THE SEVERAL VIEWS OF THE DRAWINGS

Throughout the description, similar reference numbers may be used to identify similar elements.

DETAILED DESCRIPTION

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

While many embodiments are described herein, at least some of the described embodiments provide a hybrid tag that includes an acousto-magnetic component and an RFID component.

Figure 1:
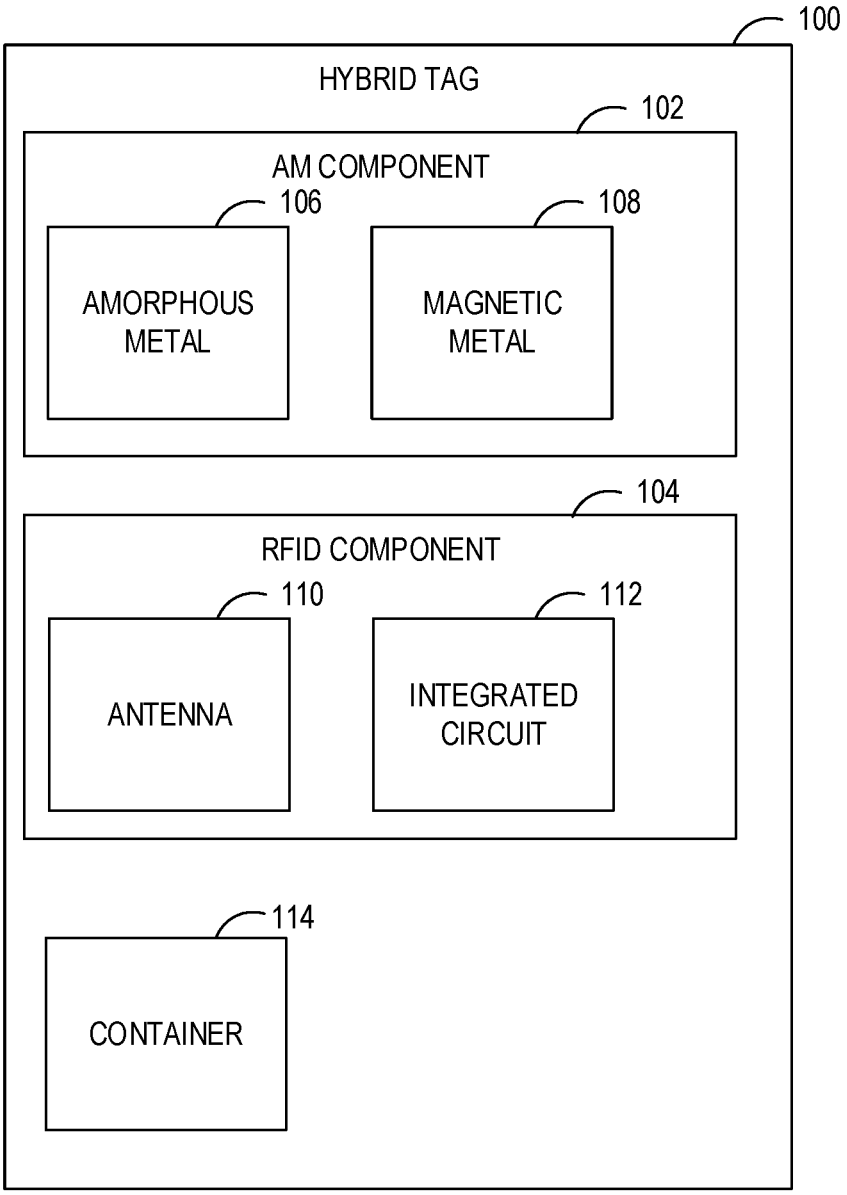
FIG. 1 is a block diagram depicting one embodiment of a hybrid tag.

FIG. 1 is a block diagram depicting one embodiment of a hybrid tag 100. The hybrid tag 100 is an electronic article surveillance ("EAS") tag that includes an amorphous metal 106, a magnetic metal 108, an antenna 110, an integrated circuit 112, and a container 114. The hybrid tag 100, in some embodiments, provides the functions of an acousto-magnetic ("AM") tag and a radio-frequency identification ("RFID") tag.

In certain embodiments, the amorphous metal 106 is formed as a strip. The amorphous metal 106 includes a metallic material with a disordered atomic-scale structure. The amorphous metal 106 may be a non-crystalline amorphous alloy having a relatively low magnetic saturation value. In some embodiments, the amorphous metal 106 is a magnetorestrictive, ferromagnetic amorphous metal. For example, the amorphous metal 106 may be a strip of METGLAS® 2605 SA1 Iron Based Alloy produced by Metglas, Inc. that includes iron alloyed with silicon and boron.

The magnetic metal 108, in certain embodiments, includes a magnetic semi-hard metal. In some embodiments, the magnetic metal 108 is formed as a strip. The magnetic metal 108 may be selectively magnetized or demagnetized by exposing the magnetic metal 108 to a magnetic field.

The magnetic metal 108 and the amorphous metal 106, in some embodiments, are disposed adjacent to one another. For example, each of the amorphous metal 106 and the magnetic metal 108 may be formed into strips that are stacked one atop another. The magnetic metal 108 and the amorphous metal 106, in some embodiments, are not bound together, but are free to oscillate mechanically relative to one another.

The amorphous metal 106 may have a resonant frequency that corresponds to a detection frequency emitted by a detector (not shown). For example, the detector may periodically emit a frequency of 58±2 kHz and the amorphous metal 106 may resonate at the same frequency. In certain embodiments, the amorphous metal 106 resonates in response to excitation by the signal produced by the detector. The detector may receive the resonant signal produced by the amorphous metal 106 to determine that the hybrid tag 100 is relatively close to the detector.

When placed adjacent to a magnetized magnetic metal 108, the amorphous metal 106 may resonate more vigorously as the magnetic metal 108 acts as a biasing magnet. When the amorphous metal 106 resonates more vigorously, the detector may more easily detect the presence of the hybrid tag 100. The detector may be calibrated such that when the hybrid tag 100 is within a predetermined distance from the detector, it indicates the presence of the hybrid tag 100 in response to the metallic metal 108 being magnetized and does not indicate the presence of the hybrid tag 100 in response to the metallic metal 108 being demagnetized.

Together, the amorphous metal 106 and the magnetic metal 108 form an AM component 102 of the hybrid tag 100. In some embodiments, the AM component 102 includes a cover to mechanically maintain the elements of the AM component 102 in a predetermined position. The cover may include any type of material. In some embodiments, the cover is a polymer, such as polyvinyl chloride (PVC). In an alternative embodiment, the cover is a textile.

The AM component 102 may be positioned within an aperture formed by the antenna 110. The antenna 110, in some embodiments, is an RFID antenna. The antenna 110 may be configured such that elements of the antenna form an aperture to receive the AM component 102. For example, the AM component 102 may have a size of 45 millimeters by eleven millimeters, and the antenna may include an aperture having dimensions larger in both axes than 45 millimeters by eleven millimeters respectively.

The antenna 110 is connected to the IC 112. The antenna 110 delivers a signal to the IC 112. The signal is derived from radio frequency waves in the environment around the hybrid tag 100.

The IC 112, in one embodiment, generates a response signal in response to a signal received from the antenna 110. The received signal may be an activation signal that has predetermined properties. For example, the received signal may be at a particular frequency, such as 8.2 MHz or 915 MHz. The IC 112 may respond to the signal with the predetermined properties by generating the response signal. The response signal may be transmitted to the antenna 110 and broadcast to the environment where it may be received by a detector (not shown).

The combination of the antenna 110 and the IC form an RFID component 104 of the hybrid tag 100. In some embodiments, the RFID component 104 includes additional elements, such as a battery, a capacitor, or an inductor.

In certain embodiments, the IC 112 receives power collected from radio waves in the environment. The radio waves received by the antenna 110 induce a current that provides power for the IC 112. The RFID component 104 may include an inductor to harvest power from radio waves. In some embodiments, the RFID component 104 includes a capacitor or a capacitor array that stores power harvested from radio waves to power the IC 112. In an alternative embodiment, the RFID component 104 includes a power source, such as a battery, to power the IC 112.

The IC 112, in one embodiment, responds to a particular, predetermined frequency of radio wave by generating a response signal. The response signal may indicate the presence of the tag within a particular space. In some embodiments, the response signal includes identifying information about the tag that can be used to determine information about the article to which it is attached. For example, the IC 112 may transmit a serial number associated with the tag and a receiver may access a database that associates that serial number with article information. The receiver may then determine an appropriate response to a determination that the article in question is within a particular area.

The container 114, in one embodiment, contains the RFID component 104 and the AM component 102. In some embodiments, the container 114 is flexible. In one embodiment, the container 114 includes a textile. For example, the container 114 may include a nylon, polyester, or cotton fabric. In another embodiment, the container 114 includes a polymer material. For example, the container 114 may include a PVC material.

Figure 2:
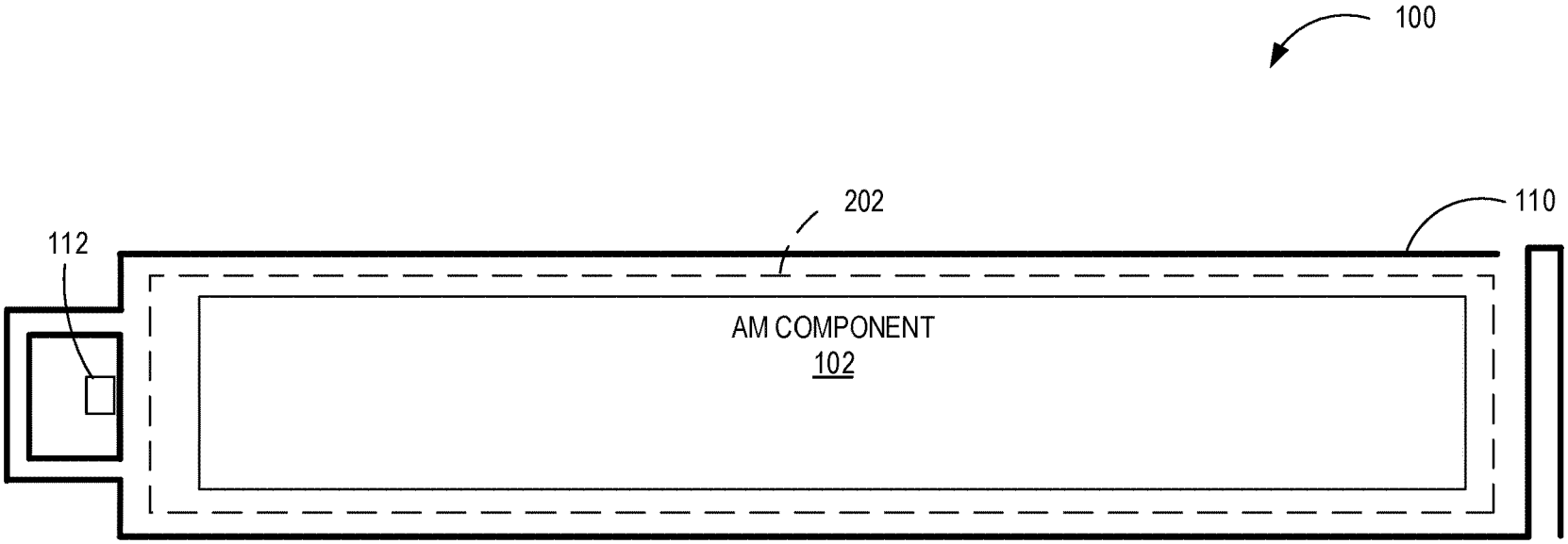
FIG. 2 is a view of an embodiment of the hybrid tag of FIG. 1.

FIG. 2 is a view of an embodiment of the hybrid tag 100 of FIG. 1. In the illustrated embodiment, the container 114 is not shown for ease of viewing internal components of the hybrid tag 100. The hybrid tag 100 includes the amorphous metal 106, the magnetic metal 108, the antenna 110, and the integrated circuit 112. The hybrid tag 100 interacts with a detector (not shown) to indicate that the hybrid tag 100 is within a predetermined area. The amorphous metal 106, the magnetic metal 108, the antenna 110, and the integrated circuit 112 are similar to like-numbered components described above in relation to FIG. 1.

The antenna 110 is configured to form an aperture 202 sized to receive the AM component 102 in the form of stacked amorphous metal 106 and magnetic metal 108. In some embodiments, the amorphous metal 106 and magnetic metal 108 are similar-sized strips.

In one embodiment, the antenna 110 is disposed on a plane. The antenna 110 may include elements that surround or substantially surround an aperture 202 to receive the AM component 102, including the AM component 102. The antenna 110, in one embodiment, has no components within the aperture 202.

In some embodiments, the configuration of the antenna 110 around the AM component 102 interacts with signal that excites the amorphous metal 106 to amplify the response of the amorphous metal 106. In one embodiment, the response of the amorphous metal 106 is improved by the surrounding antenna 110, and an effective range of detection for the AM component 102 is thereby increased. In some embodiments, there is an interaction between the antenna 110 and the AM component 102 such that the antenna 110 is electro-magnetically coupled with the amorphous metal 106 and/or the magnetic metal 108 in a way that enhances the response of the AM component 102.

Figure 3:
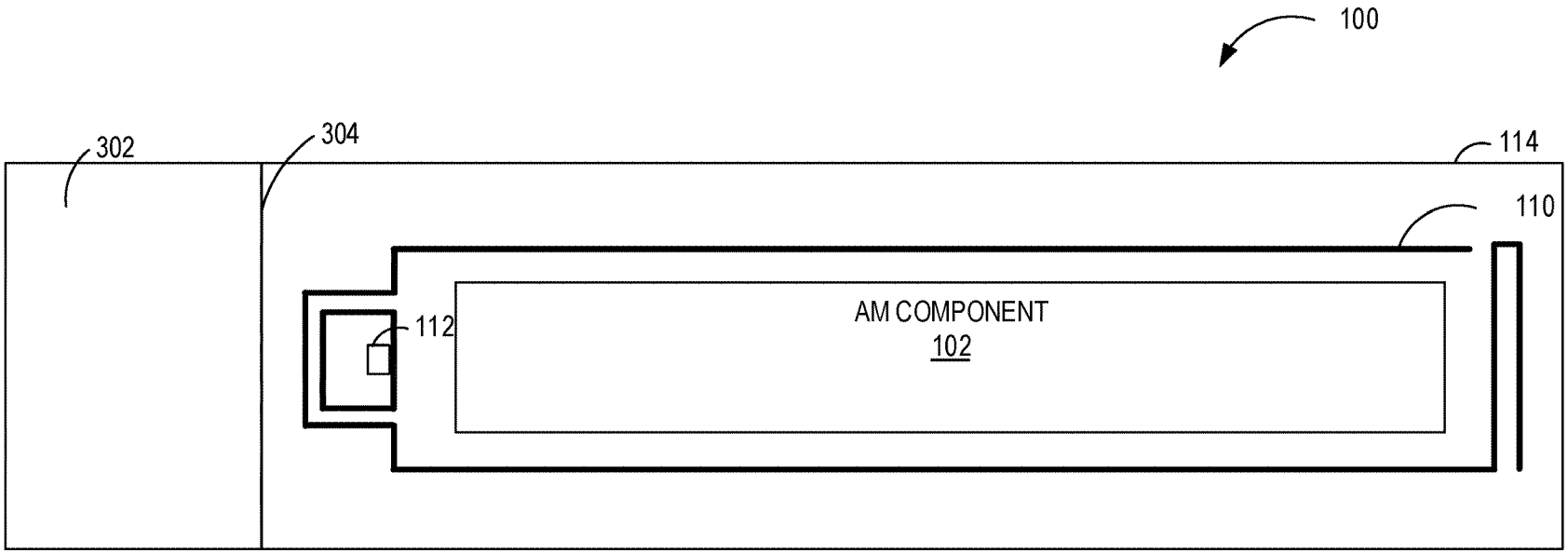
FIG. 3 is a view of an embodiment of the hybrid tag of FIG. 1 with a partial view of the flexible container.

FIG. 3 is a view of an embodiment of the hybrid tag 100 of FIG. 1 with a partial view of the flexible container 114. In the illustrated embodiment, the container 114 is shown with a portion of the top surface removed for ease of viewing internal components of the hybrid tag 100. The hybrid tag 100 includes the AM component 102, the antenna 110, the integrated circuit 112, and the container 114. The hybrid tag 100 interacts with a detector (not shown) to indicate that the hybrid tag 100 is within a predetermined area. The AM component 102, the antenna 110, the integrated circuit 112, and the container 114 are similar to like-numbered components described above in relation to FIGS. 1 and 2.

The container 114, in one embodiment, includes an attachment area 302. The attachment area 302 may be an area of the container 114 configured for attachment of the hybrid tag 100 to an article.

In one embodiment, the hybrid tag 100 is substantially planar, and attachment area 302 may be an area of the container 114 in which the other components of the hybrid tag 100 are not disposed.

In some embodiments, the attachment area 302 is indicated by a boundary line 304. The boundary line 304 may indicate that an area of the container 114 beyond the boundary line 304 is suitable for attachment to an article. In one embodiment, the boundary line 304 indicates a line beyond which other components of the hybrid tag 100 will not be present.

Figure 4:
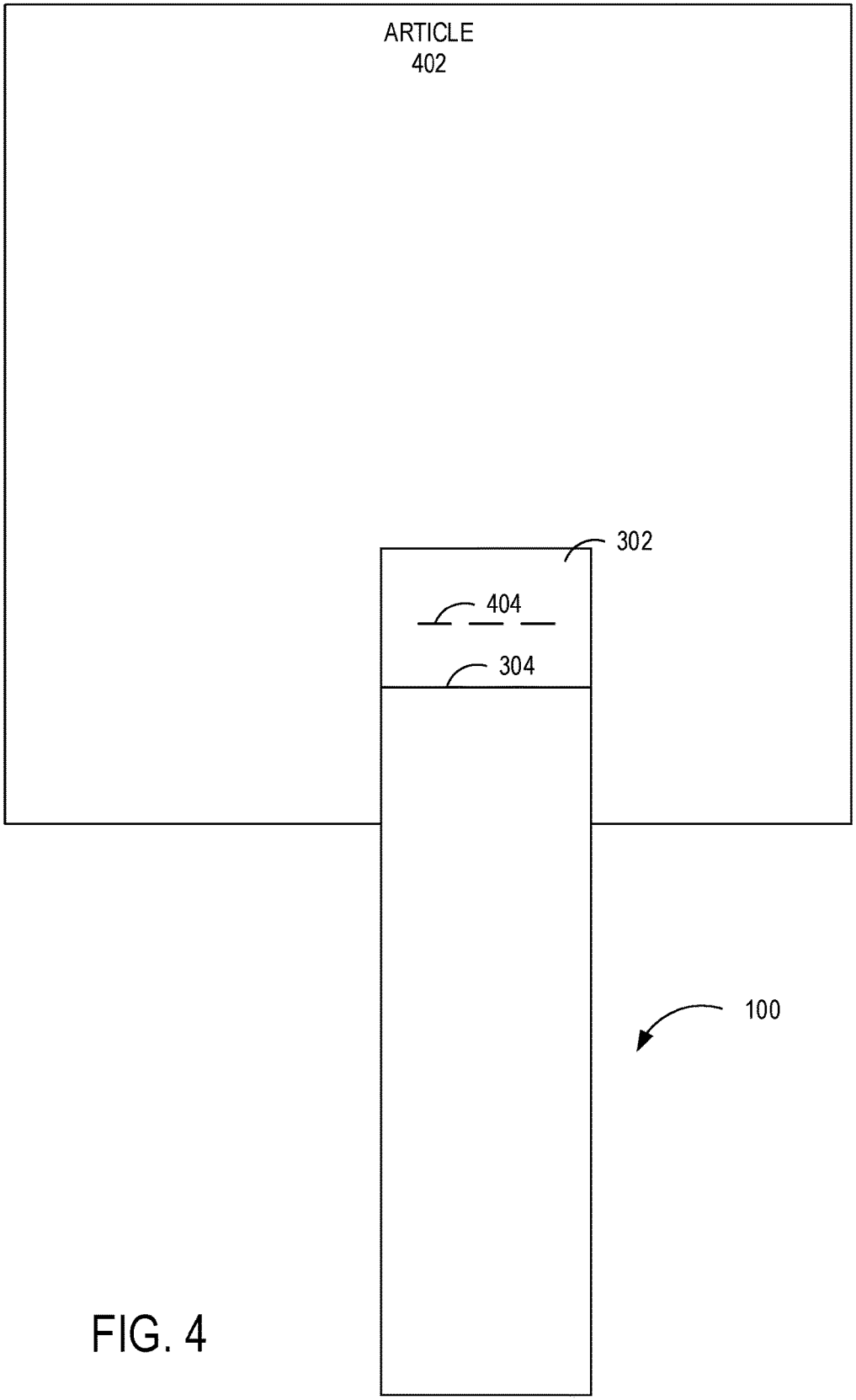
FIG. 4 is a view of one embodiment of the hybrid tag of FIG. 1 connected to an article.

FIG. 4 is a view of one embodiment of the hybrid tag 100 of FIG. 1 connected to an article 402. The hybrid tag 100 is connected to the article 402 to allow for detection of the hybrid tag 100 and the associated article 402 within a predetermined area. The hybrid tag 100, the attachment area 302, and the boundary line 304 are similar to like-numbered components described above in relation to FIGS. 1-3.

In one embodiment, the hybrid tag 100 is fastenable to the article 402 by sewing the hybrid tag 100 to the article 402 within the attachment area 302. The hybrid tag 100 may be sewn to the article 402 using any known method and any known material, such as thread 404 installed by a sewing machine. In an alternate embodiment, the attachment area 302 may be attached to the article 402 using an adhesive.

Figure 5:
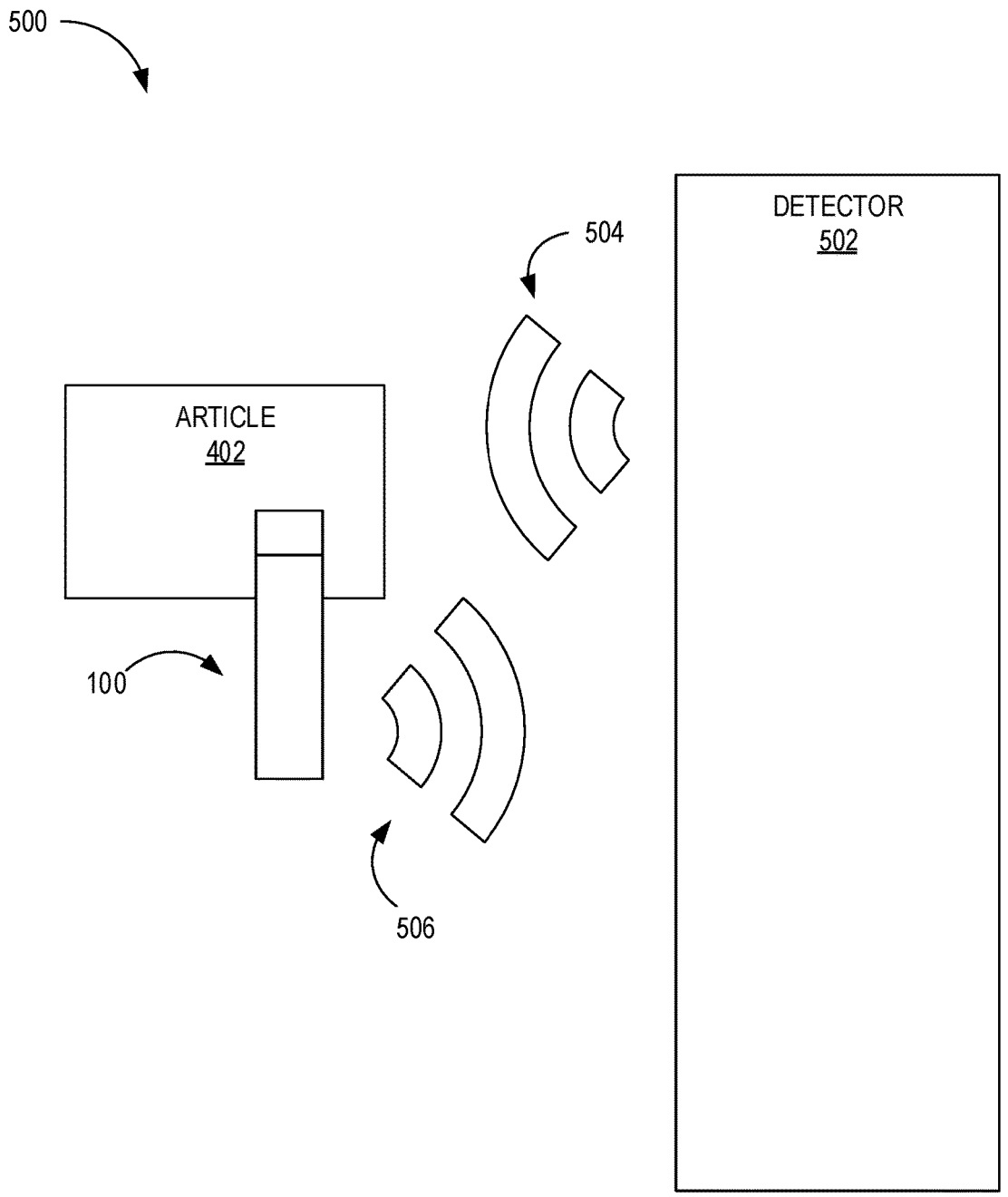
FIG. 5 is a block diagram depicting one embodiment of a system for a hybrid tag.

FIG. 5 is a block diagram depicting one embodiment of a system 500 for a hybrid tag. The system 500 includes a hybrid tag 100, an article 402, and a detector 502. The system 500 indicates a presence of the hybrid tag 100 within a predetermined proximity to the detector 502. The hybrid tag 100 and the article 402 are similar to like numbered elements described above in relation to FIGS. 1-4.

The detector 502, in one embodiment, generates a signal 504 to be broadcast. The signal 505 may be configured to activate the RFID component 104 of the hybrid tag 100 or the AM component 102 of the hybrid tag 100. In an alternate embodiment, the detector may generate a signal 504 configured to activate the RFID component 104 of the hybrid tag 100 and a second signal configured to activate the AM component 102 of the hybrid tag 100.

The hybrid tag 100 may generate a response signal 506 in response to the signal 504 broadcast by the detector 502. In one embodiment, the response signal 506 is received by the detector 502. The detector, in certain embodiments, responds to receiving the response signal 506 by indicating that the hybrid tag is within a predetermined area.

In the illustrated embodiment, the detector 502 is a single assembly configured to both transmit the signal 504 and receive the response signal 506. In an alternate embodiment, the detector 502 includes an assembly configured to broadcast the signal 504 and a second assembly configured to receive the response signal 506.

Figure 6:
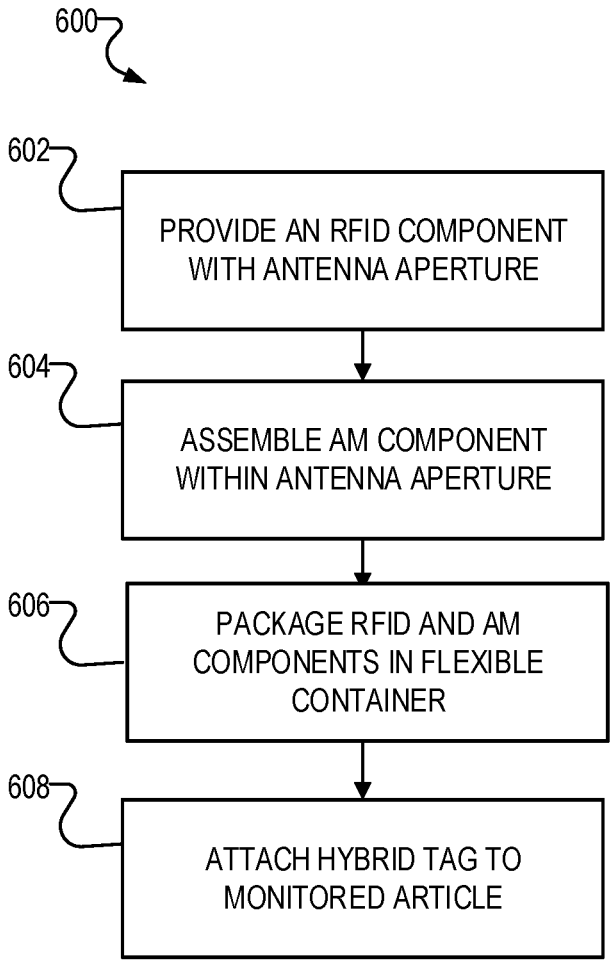
FIG. 6 depicts a flowchart diagram showing an embodiment of a method for manufacturing a hybrid tag.

FIG. 6 depicts a flowchart diagram showing an embodiment of a method 600 for manufacturing a hybrid tag 100. The method 600 is in certain embodiments a method of use of the system and apparatus of FIGS. 1-5, and will be discussed with reference to those figures. Nevertheless, the methods may also be conducted independently thereof and are not intended to be limited specifically to the specific embodiments discussed above with respect to those figures.

FIG. 6 illustrates a method 600 for manufacturing a hybrid tag 100. As shown in FIG. 6, an RFID component 104 with an antenna aperture 202 is provided 602. The aperture 202 may be sized to receive an AM component 102.

In some embodiments, the AM component 102 is assembled 604 within the aperture 202. The AM component 102 may be assembled 604 such that the antenna 110 is planar and elements of the antenna 110 surround or substantially surround the AM component 102.

The RFID component 104 and the AM component 102, in some embodiments, are packaged 606 within a flexible container 114. The flexible container 114 may be a textile package that surrounds the RFID component 104 and the AM component 102.

In certain embodiments, the hybrid tag 100 is attached 608 to a monitored article 402. The hybrid tag 100 may be attached 608 by sewing the container 114 to the article 402 within an attachment area 302.

Figure 7:
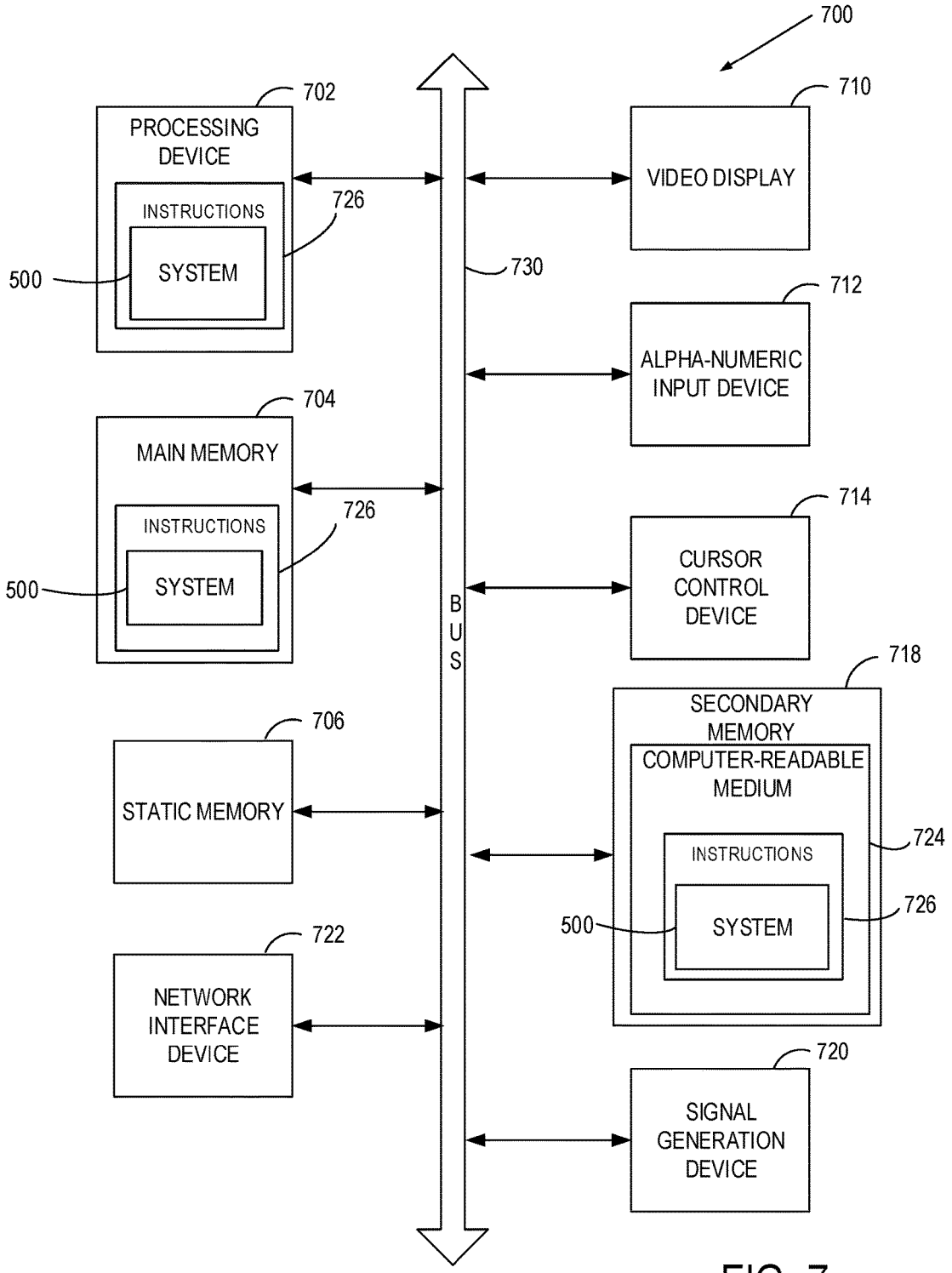
FIG. 7 is a diagram of one embodiment of a computer system for facilitating the execution of the system of FIG. 5.

FIG. 7 is a diagram of one embodiment of a computer system 700 for facilitating the execution of the system 500 of FIG. 5. Within the computer system 700 is a set of instructions for causing the machine to perform any one or more of the methodologies discussed herein. In alternative embodiments, the machine may be connected (e.g., networked) to other machines in a LAN, an intranet, an extranet, or the Internet. The machine can be a host in a cloud, a cloud provider system, a cloud controller or any other machine. The machine can operate in the capacity of a server or a client machine in a client-server network environment, or as a peer machine in a peer-to-peer (or distributed) network environment. The machine may be a personal computer (PC), a tablet PC, a console device or set-top box (STB), a Personal Digital Assistant (PDA), a cellular telephone, a web appliance, a server, a network router, switch or bridge, or any machine capable of executing a set of instructions (sequential or otherwise) that specify actions to be taken by that machine. Further, while only a single machine is illustrated, the term "machine" shall also be taken to include any collection of machines (e.g., computers) that individually or jointly execute a set (or multiple sets) of instructions to perform any one or more of the methodologies discussed herein.

The exemplary computer system 700 includes a processing device 702, a main memory 704 (e.g., read-only memory (ROM), flash memory, dynamic random access memory (DRAM) such as synchronous DRAM (SDRAM) or DRAM (RDRAM), etc.), a static memory 706 (e.g., flash memory, static random access memory (SRAM), etc.), and a secondary memory 718 (e.g., a data storage device in the form of a drive unit, which may include fixed or removable computer-readable storage medium), which communicate with each other via a bus 730.

Processing device 702 represents one or more general-purpose processing devices such as a microprocessor, central processing unit, or the like. More particularly, the processing device 702 may be a complex instruction set computing (CISC) microprocessor, reduced instruction set computing (RISC) microprocessor, very long instruction word (VLIW) microprocessor, processor implementing other instruction sets, or processors implementing a combination of instruction sets. Processing device 702 may also be one or more special-purpose processing devices such as an application specific integrated circuit (ASIC), a field programmable gate array (FPGA), a digital signal processor (DSP), network processor, or the like. Processing device 702 is configured to execute the instructions 726 for performing the operations and steps discussed herein.

The computer system 700 may further include a network interface device 722. The computer system 700 also may include a video display unit 710 (e.g., a liquid crystal display (LCD) or a cathode ray tube (CRT)) connected to the computer system through a graphics port and graphics chipset, an alphanumeric input device 712 (e.g., a keyboard), a cursor control device 78 (e.g., a mouse), and a signal generation device 720 (e.g., a speaker).

The secondary memory 718 may include a machine-readable storage medium (or more specifically a computer-readable storage medium) 724 on which is stored one or more sets of instructions 726 embodying any one or more of the methodologies or functions described herein. In one embodiment, the instructions 726 include instructions for the system 500. The instructions 726 may also reside, completely or at least partially, within the main memory 704 and/or within the processing device 702 during execution thereof by the computer system 700, the main memory 704 and the processing device 702 also constituting machine-readable storage media.

The computer-readable storage medium 724 may also be used to store the instructions 726 persistently. While the computer-readable storage medium 724 is shown in an exemplary embodiment to be a single medium, the term "computer-readable storage medium" should be taken to include a single medium or multiple media (e.g., a centralized or distributed database, and/or associated caches and servers) that store the one or more sets of instructions. The term "computer-readable storage medium" shall also be taken to include any medium that is capable of storing or encoding a set of instructions for execution by the machine and that cause the machine to perform any one or more of the methodologies of the present invention. The term "computer-readable storage medium" shall accordingly be taken to include, but not be limited to, solid-state memories, and optical and magnetic media.

The instructions 726, components and other features described herein can be implemented as discrete hardware components or integrated in the functionality of hardware components such as ASICS, FPGAs, DSPs or similar devices. In addition, the instructions 726 can be implemented as firmware or functional circuitry within hardware devices. Further, the instructions 726 can be implemented in any combination hardware devices and software components.

In the above description, numerous details are set forth. It will be apparent, however, to one skilled in the art, that the present invention may be practiced without these specific details. In some instances, well-known structures and devices are shown in block diagram form, rather than in detail, in order to avoid obscuring the present invention.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "providing," "generating," "installing," "monitoring," "enforcing," "receiving," "logging," "intercepting," "computing," "calculating," "determining," "presenting," "processing," "confirming," "publishing," "receiving," "applying," "detecting," "selecting," "updating," "assigning," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices. In addition, unless specifically stated otherwise as apparent from the following discussion, it is appreciated that throughout the description, discussions utilizing terms such as "manager," "receiver," "generator," "tracker," "biaser," "calculator," "associator," detector," "publisher," or the like, refer to processes operating on a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

It is to be understood that the above description is intended to be illustrative, and not restrictive. Many other embodiments will be apparent to those of skill in the art upon reading and understanding the above description. Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense. The scope of the invention should, therefore, be determined with reference to the appended claims, along with the full scope of equivalents to which such claims are entitled.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

It should also be noted that at least some of the operations for the methods described herein may be implemented using software instructions stored on a computer useable storage medium for execution by a computer. Embodiments of the invention can take the form of an entirely hardware embodiment, an entirely software embodiment, or an embodiment containing both hardware and software elements. In one embodiment, the invention is implemented in software, which includes but is not limited to firmware, resident software, microcode, etc.

Furthermore, embodiments of the invention can take the form of a computer program product accessible from a computer-usable or computer-readable storage medium providing program code for use by or in connection with a computer or any instruction execution system. For the purposes of this description, a computer-usable or computer readable storage medium can be any apparatus that can store the program for use by or in connection with the instruction execution system, apparatus, or device.

The computer-useable or computer-readable storage medium can be an electronic, magnetic, optical, electromagnetic, infrared, or semiconductor system (or apparatus or device), or a propagation medium. Examples of a computer-readable storage medium include a semiconductor or solid state memory, magnetic tape, a removable computer diskette, a random access memory (RAM), a read-only memory (ROM), a rigid magnetic disk, and an optical disk. Current examples of optical disks include a compact disk with read only memory (CD-ROM), a compact disk with read/write (CD-R/W), and a digital video disk (DVD).

An embodiment of a data processing system suitable for storing and/or executing program code includes at least one processor coupled directly or indirectly to memory elements through a system bus such as a data, address, and/or control bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers. Additionally, network adapters also may be coupled to the system to enable the data processing system to become coupled to other data processing systems or remote printers or storage devices through intervening private or public networks. Modems, cable modems, and Ethernet cards are just a few of the currently available types of network adapters.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A hybrid tag comprising:

an RFID component comprising:

an RFID antenna comprising an aperture sized to receive an acousto-magnetic component;

an integrated circuit connected to the RFID antenna;

an acousto-magnetic component disposed within the aperture, the acousto-magnetic component comprising:

an amorphous metal;

a magnetic metal disposed on the amorphous metal;

a flexible container covering the RFID component and the acousto-magnetic component.

2. The hybrid tag of claim 1, wherein the flexible container comprises a textile.

3. The hybrid tag of claim 1, wherein the flexible container comprises a flexible polymer.

4. The hybrid tag of claim 1, wherein the flexible container comprises an attachment area.

5. The hybrid tag of claim 4, wherein the RFID component and the acousto-magnetic component are disposed in areas of the flexible container other than the attachment area.

6. The hybrid tag of claim 4, wherein the flexible container comprises a boundary indicator disposed at an edge of the attachment area.

7. The hybrid tag of claim 4, wherein the attachment area is attachable to an article through a sewing process.

8. The hybrid tag of claim 4, wherein the attachment area comprises a thread, the thread sewn through the attachment area and the thread sewn through an article.

9. The hybrid tag of claim 4, wherein the attachment area comprises an adhesive.

10. A system for a hybrid tag, the system comprising:

an RFID component comprising:

an RFID antenna comprising an aperture sized to receive an acousto-magnetic component;

an integrated circuit connected to the RFID antenna;

an acousto-magnetic component disposed within the aperture, the acousto-magnetic component comprising:

an amorphous metal;

a magnetic metal disposed adjacent to the amorphous metal;

a flexible container covering the RFID component and the acousto-magnetic component;

an article connected to the flexible container.

11. The system of claim 10, further comprising a detector configured to activate one of the RFID component and the acousto-magnetic component.

12. The system of claim 10, further comprising a detector configured to receive a signal from one of the RFID component and the acousto-magnetic component.

13. A method of manufacturing a hybrid tag, the method comprising:

disposing an amorphous metal adjacent to a magnetic metal to form an acousto-magnetic component;

disposing the acousto-magnetic component in an aperture formed by an RFID antenna;

connecting the RFID antenna to an integrated circuit to form an RFID component;

disposing the acousto-magnetic component and the RFID component within a flexible container.

14. The method of claim 13, further comprising connecting the flexible container to an article.

15. The method of claim 13, further comprising sewing the flexible container to an article.

* * * * *